US006708745B2

(12) United States Patent
Huang

(10) Patent No.: US 6,708,745 B2
(45) Date of Patent: Mar. 23, 2004

(54) DECORATED FILIGREE CONTAINER

(75) Inventor: Wendy H. Huang, New York, NY (US)

(73) Assignee: Eastern Directory, Inc., New York, NY (US)

( * ) Notice: Subject to any disclaimer, the term of this patent is extended or adjusted under 35 U.S.C. 154(b) by 22 days.

(21) Appl. No.: 10/090,958

(22) Filed: Mar. 4, 2002

(65) Prior Publication Data

US 2003/0164217 A1 Sep. 4, 2003

(51) Int. Cl.[7] ..... A45C 3/06; A45C 13/06; A45C 13/08

(52) U.S. Cl. ..... 150/127; 150/120; 150/129; 220/62.14; 428/542.2

(58) Field of Search ..... 150/100, 118, 150/120, 123, 127, 129; D3/232, 234, 237, 239, 903; 206/6.1; 220/62.14; D9/420; 428/542.2

(56) References Cited

U.S. PATENT DOCUMENTS

| | | | | | |
|---|---|---|---|---|---|
| 624,863 | A | * | 5/1899 | Prahar | 150/123 |
| 726,166 | A | * | 4/1903 | Irons | 150/127 X |
| 1,013,580 | A | * | 1/1912 | Babst | 150/100 |
| D73,146 | S | * | 7/1927 | Poeter | D3/239 |
| 1,738,802 | A | * | 12/1929 | Stanley | 150/118 |
| 2,116,810 | A | * | 5/1938 | Warner | 206/6.1 |
| 2,316,262 | A | * | 4/1943 | Lewis | 150/123 X |
| 2,318,694 | A | * | 5/1943 | Kaphan | 150/127 |
| D147,234 | S | * | 8/1947 | Glaser | D3/239 |
| 2,502,221 | A | * | 3/1950 | Kaplan | 150/127 X |
| 2,508,669 | A | * | 5/1950 | Glover | 150/127 |
| 2,518,572 | A | * | 8/1950 | Sanders | 150/127 X |
| 2,606,588 | A | * | 8/1952 | Kaufman | 150/127 X |
| 3,455,359 | A | * | 7/1969 | Schweitzer | 150/123 |
| 4,962,800 | A | * | 10/1990 | Owiriwo | 150/118 |
| 6,247,584 | B1 | * | 6/2001 | Au | 206/6.1 |

FOREIGN PATENT DOCUMENTS

| | | | | |
|---|---|---|---|---|
| AU | 237421 | * | 3/1960 | 150/123 |
| FR | 547954 | * | 12/1922 | 150/123 |
| FR | 1374219 | * | 8/1964 | 150/123 |
| FR | 2304302 | * | 10/1976 | 150/118 |

* cited by examiner

*Primary Examiner*—Sue A. Weaver
(74) *Attorney, Agent, or Firm*—Abelman, Frayn & Schwab

(57) ABSTRACT

A rigid container for use as a ladies' evening bag or a home or office furnishing is formed by a pair of highly decorated hinged side elements each formed with an integral abutting frame member that surrounds the opening. The side walls of the container are formed of decorative open work or filigree patterns that extend to the interior in which a fabric liner is secured to the inner surfaces of the walls and is clearly visible through the openings of the side walls, thereby providing an unusual and pleasing aesthetic effect.

19 Claims, 4 Drawing Sheets

FIG. 2
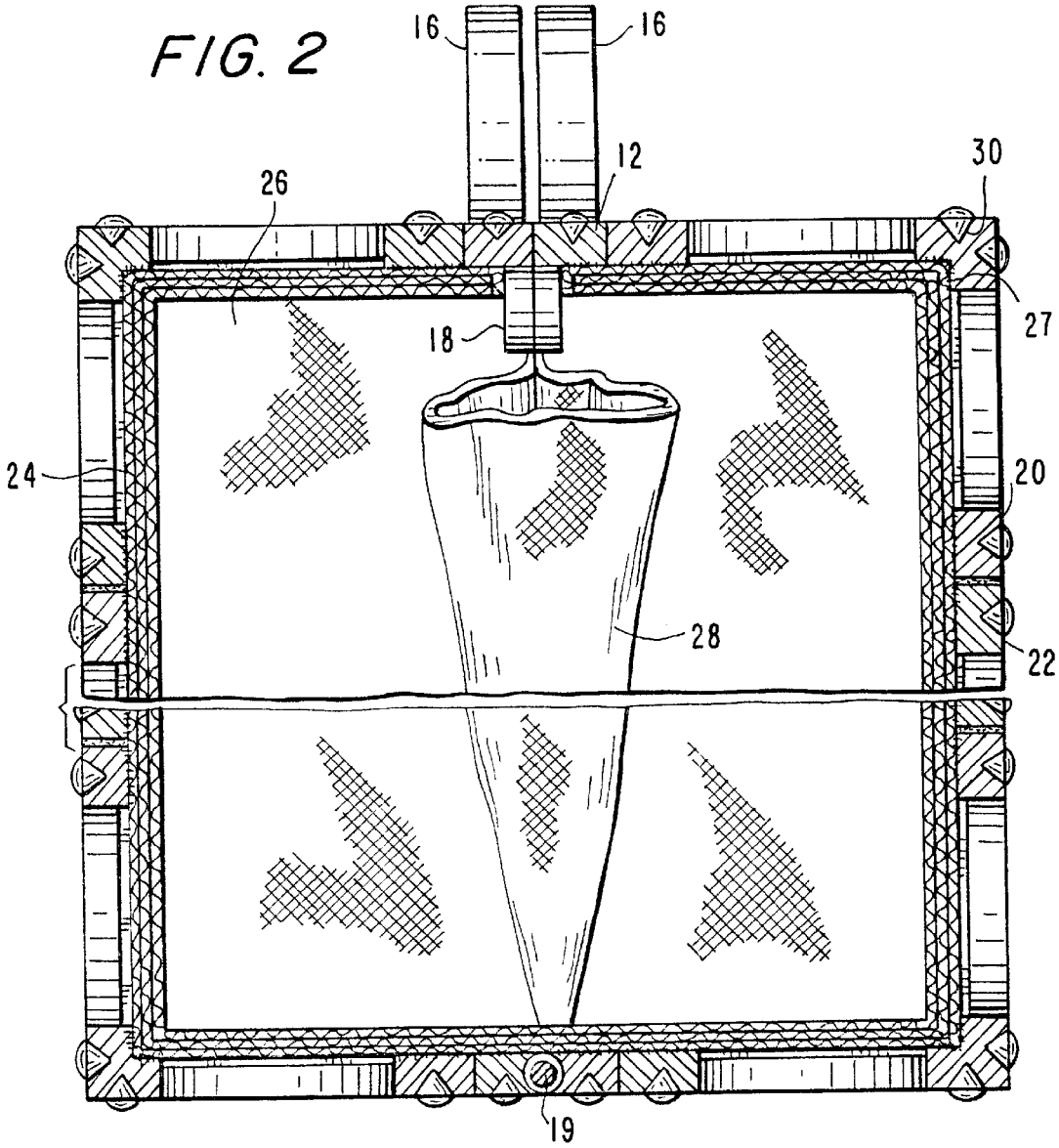
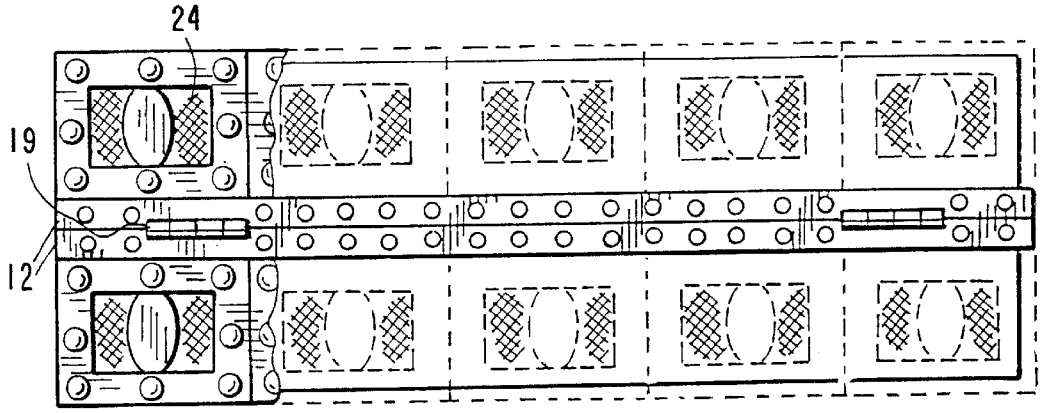
FIG. 3

DECORATED FILIGREE CONTAINER

FIELD OF THE INVENTION

The invention relates to a cast metal or other rigid material that is formed with filigree or decorative open-work that is the form of a container, a lady's evening bag or decorative storage box.

BACKGROUND OF THE INVENTION

Decorated storage boxes and containers are known from the times of ancient civilizations. Decorated handbags, purses and the like have also been known for centuries. As used herein, the word "container" will include decorated storage boxes, containers, handbags, evening bags and purses customarily carried by women to formal events, and the like.

SUMMARY OF THE INVENTION

The invention of the present invention is a rigid container formed by a pair of hinged side elements each formed with an integral frame member that surrounds the opening and contacts its counterpart when the container is in the closed position. The frame member's external surface is preferably decorated.

The walls forming the container are form filigree patterns leading to the interior space. A inner surfaces of the walls and is clearly visible through the openings of the side walls, thereby providing an unusual and pleasing aesthetic effect.

The rigid frame members surrounding each of the side sections of the container are, in a preferred embodiment, provided with ferromagnetic fastening elements that retain the container in the closed configuration, which are preferably located on the interior of the container. The exterior of the frame members are preferably provided with projecting handles or guys to facilitate separating the sides to open the container.

The side walls can be of a unitary construction, or formed by joining together numerous individual pieces of regular or irregular shapes and configurations. The container itself can be rectilinear, formed exclusively of curved elements, or a combination of curvilinear and straight portions. For example, the container can be square, rectangular, spherical, heart-shaped, or an oblate spheroid.

In one principle aspect the invention is directed to a decorated container that comprises:

(1) a pair of abutting rigid external frame members joined by one or more hinges and supporting means for opening and retaining the container in a closed position, the external surface of the frame members being decorated or ornamented.

(2) side walls formed with an open work or filigree pattern through which can be seen the interior of the container the external surfaces of the side walls being decorated or ornamented; and (3) a fabric lining affixed to an interior surface of the side walls and visible through the open work of the sidewalls.

BRIEF DESCRIPTION OF THE DRAWINGS

The invention will be further described below and wit reference to the attached drawings in which:

FIG. 2 is a cross-sectional view of FIG. 1 along line 2—2;

FIG. 3 is bottom view;

DESCRIPTION OF THE PREFERRED EMBODIMENTS

A decorative container 10, such as a highly ornamented lady's evening bag, is formed from a pair of hinged frame members 12 which form the respective openings for the opposing sides 14 of the container. Each of the frame members 12 is preferably provided with clasp members 16 that facilitates the opening of the container.

Figure 1:
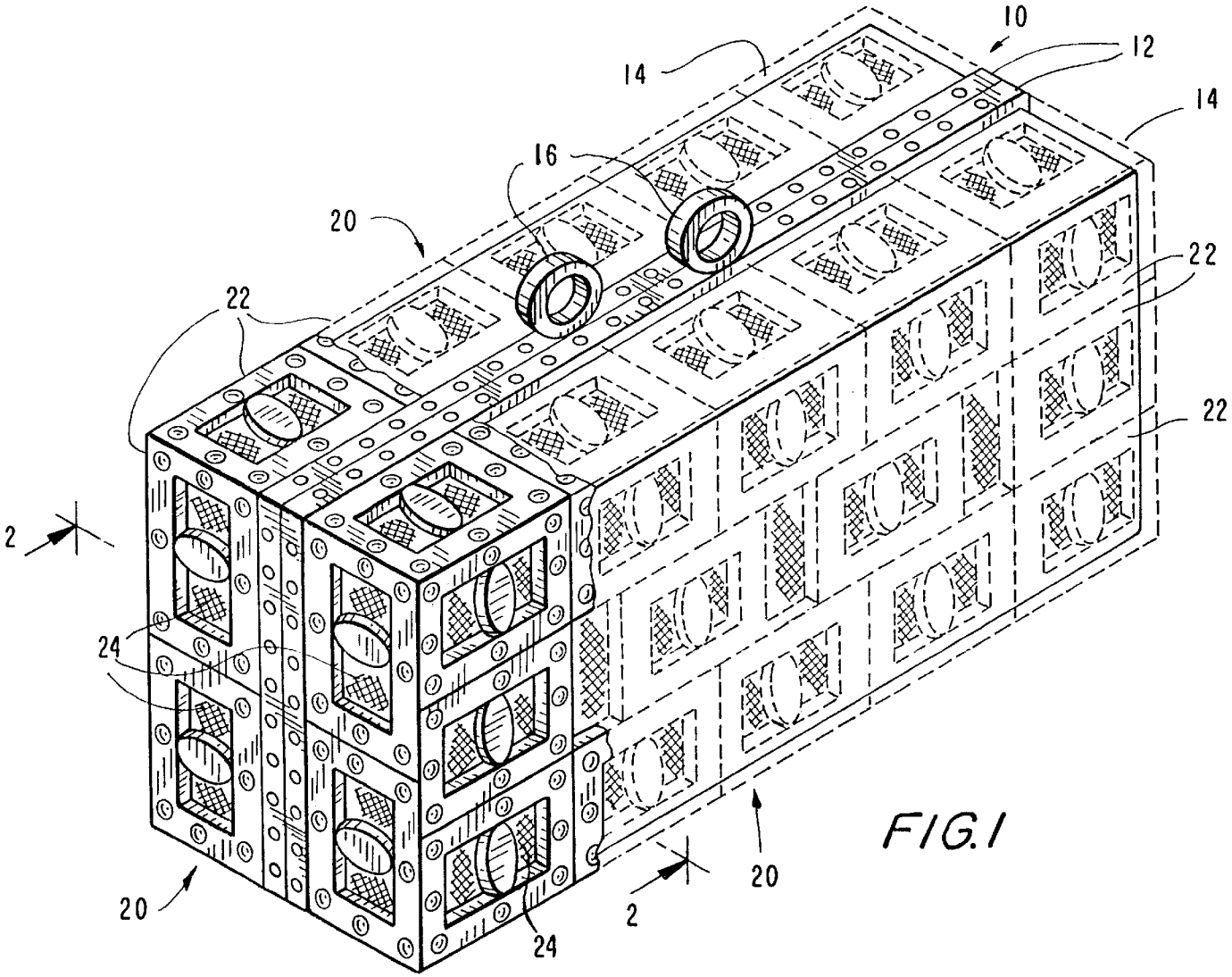
FIG. 1 is front top left perspective view of a representative embodiment of a container constructed in accordance with the invention.
Figure 4:
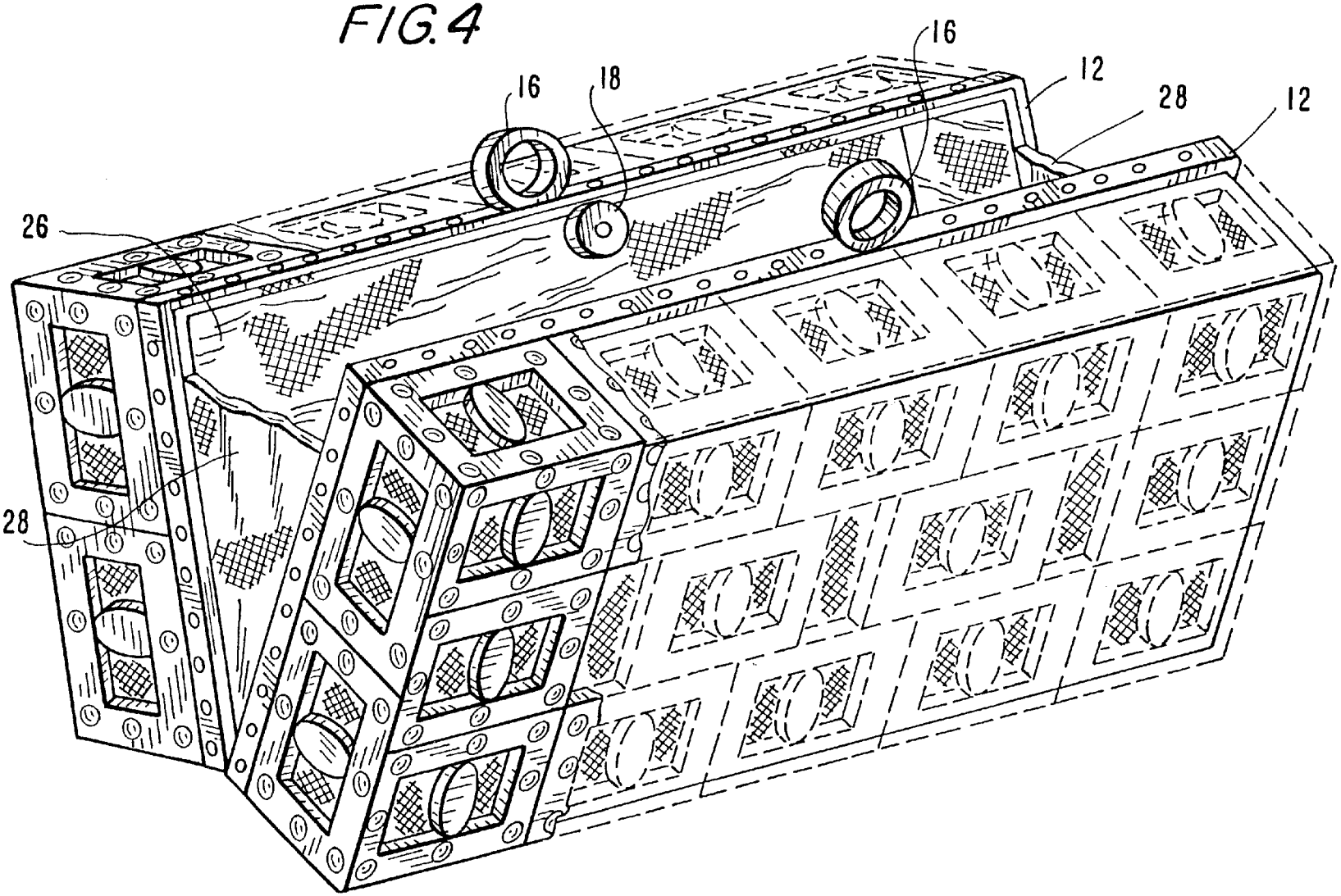
FIG. 4 is a perspective view similar to FIG. 1, showing the container in an open position.

In a particularly preferred embodiment, and as shown in FIG. 4, a ferromagnetic closure 18 of the type that has been commonly used in ladies' hand bags is secured to each of the opposing frame members 12 and positioned on the interior of the respective sides. When the frame members are brought into proximity as the container is closed, the magnetic attraction causes the opposing sides of the closure members 18 to be drawn into a secure mated closed position, as in FIGS. 1 and 2.

The sidewalls 20 of the containers are formed from one or more cast rigid elements 22 to provide an open network or filigree pattern 24 in the sidewalls. The sidewalls can be rectilinear in configuration and also formed from rectilinear or other shaped elements in a manner that leaves a plurality of open spaces to form the filigree pattern. Alternatively, the opposing frame members can be curvilinear or formed from regular or irregular curved elements in combination with straight and/or angled elements, in accordance with the desires and imagination of the designer. When the opposing frame members are curvilinear, the opposing sidewalls of the container will likewise include curved elements, always forming an open network or filigree pattern. The invention is not limited to any particular shape or configuration. The abutting frame members 12 can be round, heart-shaped and/or rectilinear. The sidewalls 14 can be flat, angled or curved.

As will be understood from the above description, the openings in the construction of the sidewalls allow a view into the interior of the container and likewise would allow small items placed in the container to pass through the openings and be lost. In order to achieve an unusual and pleasing aesthetic appearance, a fabric 26 is secured to the interior surface of the frame and cast sidewalls on each side of the container. As shown in FIG. 2, the fabric lining 26 is secured to the interior sidewalls of the open network using a conventional fabric glue 27. In a particularly preferred embodiment, the fabric that is secured to the interior of the sidewall is a part of a laminated or layered liner. The liner can be comprised of a further intermediate fabric layer of substantial construction and a third decorative fabric of finer quality which serves as the interior liner of the container. In the embodiment as illustrated in FIG. 4, a gusset 28 is provided in the fabric that serves to limit to separation of the two side sections of the container. The intermediate layer can be a thicker, tear-resistant material, either woven or non-woven, that also provides a cushioning for the contents of the container.

Figure 5:
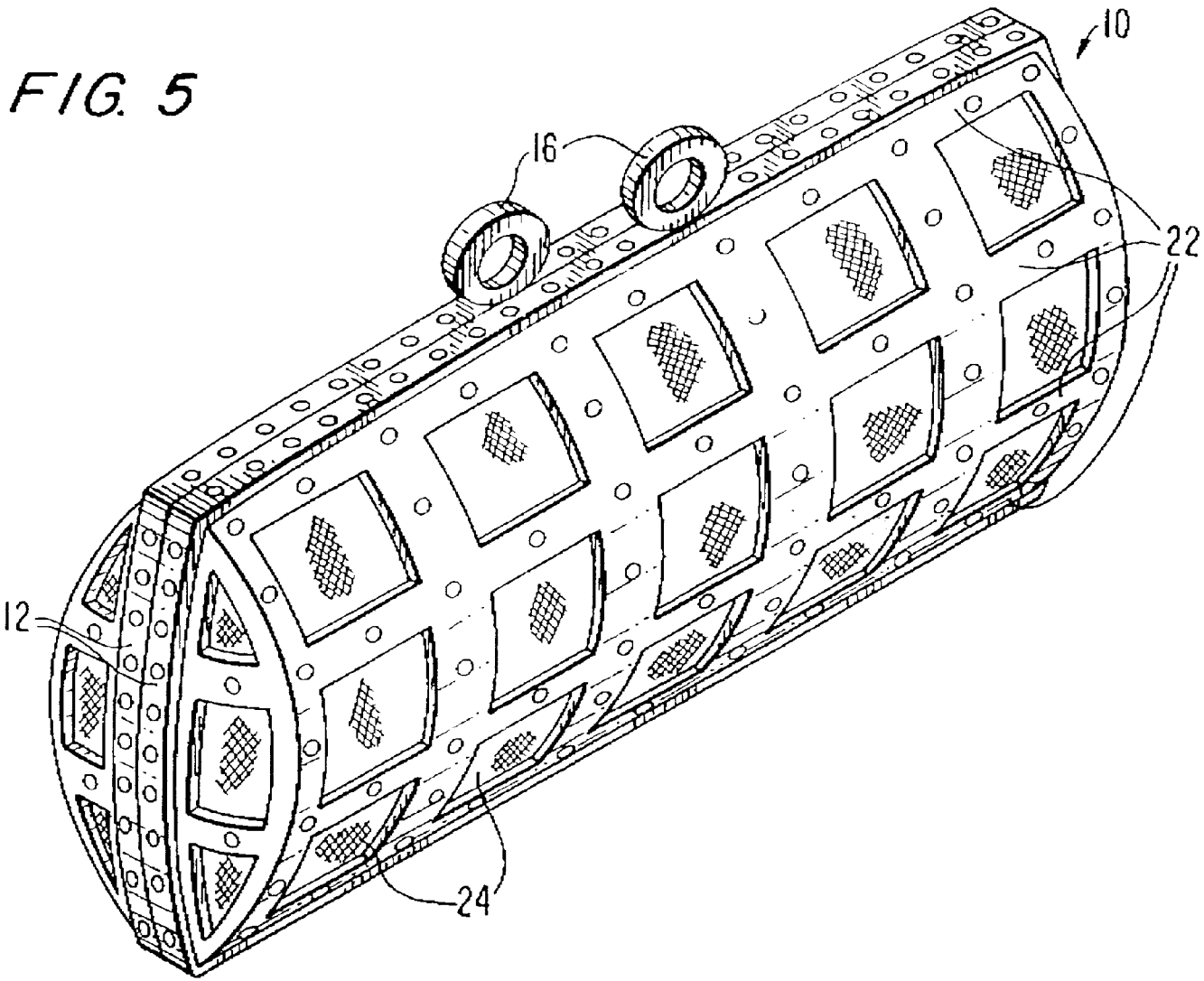
FIG. 5 is a front top left perspective view of another embodiment of the invention having curvilinear walls.

As shown in FIG. 5, the walls 20 of the container 10 can be of curved or arcuate configuration and joined to linear frame members 12. As will be apparent to one of ordinary skill in the art, other combinations of sidewalls and frame members are possible.

In order to facilitate the fitting of the composite construction of the filigree backing fabric, the intermediate fabric layer and the interior liner layer are preferably cut to a pattern corresponding to the interior configuration of the respective sides of the container and sewn or glued as necessary, so that the three-layered assembly can be mounted to the interior of the container sides as a unitary element. The placement of the fabric assembly is preferably undertaken as the final step in the construction of the container.

In a further preferred embodiment illustrated in FIG. 2, the opposing frame members 12, as well as the elements or members forming the sidewalls are provided with a plurality of shallow recesses 30 for receiving surface ornamentation and decorative elements, such as faceted glass crystals having the appearance of diamonds, semi-precious stones, precious stones, pearls and any other ornamentation that is available to the designer.

As noted above, the sidewalls 20 of the container can be cast from metal or any other rigid material. The sidewalls can be formed as a unitary casting and can also include the respective frame elements 18 forming the opening of each side. The sidewalls can also be formed from individual cast elements 22 produced from a rigid but malleable metal that can be shaped over a mandril or die that conforms to the configuration of the interior of the container. This method is particularly suitable for shaping curvilinear elements that are then soldered or otherwise joined between the sides of the frame member to construct a side from a plurality of individual decorative elements.

As will be understood from the above description of the surface ornamentation that is to be applied, each of the individual elements that ultimately form the container idewalls and frame members are preferably provided with a plurality of shallow cast recesses for receiving the individual ornamentation, such as rhinestones, precious and semi-precious stones, pearls and/or other types of decorative elements that are glued in place.

The method of assembly of the container of the invention includes affixing the magnetic closure elements 18 to the respective sides of the opposing frame members 12, affixing the exterior finger clasps 16 which provide the means for separating the magnetic closure members and affixing one or more hinges 19 to the frame members opposite the clasps. The frame members can also be provided with one or more loops or rings (not shown) for attachment of a handle or shoulder strap for carrying the container.

The sidewalls 20 of the container are then assembled to the frame. Each of these assembly steps is preferably done by soldering the respective elements in position. It has been found that the use of solder is preferable to provide a rigid, shock-resistant construction.

Alternatively, an epoxy composition or other suitable adhesive composition(s) can be employed for securing one or more of the elements to the frame. The assembled container can be dipped in appropriate cleaning compositions and can, if desired, be plated to create a uniform appearance prior to affixing the decorative components. Other types of metal treatment, including painting or enameling can be employed.

The next step in the manufacture of the container is to set the exterior ornamentation in place in the recesses provided. This is preferably accomplished by use of liquid adhesive compositions such as epoxy that are well-known in the field of jewelry manufacture.

Any type of ornamentation can be utilized that is within the imagination of the designer or artisan. The frame members and sidewalls can also be engraved or otherwise provided with designs to enhance the effect. Thus, leaves, vines, flowers, geometric and irregular shapes and forms can be incorporated into the basic construction of frame members and sidewalls. Separate ornamentation can be omitted, or used sparingly to achieve a desired aesthetic effect in combination with the open work filigree through which the decorative fabric lining is clearly visible.

After the individual items of exterior surface ornamentation have been placed and the adhesive composition cured or dried, the interior surfaces of the opposing frame members and the interior surfaces of the open network of castings that form the sidewalls are coated with a liquid adhesive in preparation for placement of the fabric lining. The liquid adhesive composition is of the type commonly used for bonding fabrics. The edge of the fabric lining assembly is initially positioned against the interior of the frame of one side of the container and then the fabric is pressed against the glue that has been applied to the interior open casting surface of the sidewall and allowed to dry.

The completed assembly provides a highly ornamented exterior surface having an open network through which is visible the exterior surface of the fabric lining. The combination of metal, decorative fabric and varying surface ornamentation, such as cut glass or stones, pearls, ceramic elements and the like, provides an unusual and aesthetically pleasing effect based upon the combination of contrasting materials and textures.

I claim:

1. A decorated container comprising:

a. a pair of abutting rigid external frame members defining an opening to the interior of the container, the frame members joined by one or more hinges, the external surface of the frame members being decorated;

b. rigid side walls joined to the frame members and forming the sides of the container, each of the side walls formed with an open-work filigree pattern extending through to the interior of the container, the side walls being of cast construction and forming a unitary structure defining substantially all of the external surface of the container, the external surface of the sidewalls being decorated with separate decorative components; and c. a fabric lining secured to an interior surface of the side walls and visible through the open work filigree pattern of the cast sidewalls when the container is closed.

2. The container of claim 1, further comprising releasable retaining means to maintain the frame members in a closed position.

3. The container of claim 2, wherein the retaining means are magnetic.

4. The container of claim 1 further comprising clasps extending outwardly from each of the frame members.

5. The container of claim 1, wherein the frame members and sidewalls are cast metal.

6. The container of claim 1, wherein the sidewalls are of unitary cast construction.

7. The container of claim 1, wherein the sidewalls are formed from a plurality of cast elements that are joined together to form the open-work filigree pattern.

8. The container of claim 7, wherein each of the plurality of cast elements is provided with openings extending from the exterior surface to the interior surface.

9. The container of claim 1, wherein the container is plated.

10. The container of claim 1, wherein the container is decorated with decorative components selected from the group consisting of pearls, rhinestones, precious and semi-precious stones, and combinations of the above.

11. The container of claim 10, further comprising recesses in the exterior surface of the frame members and the sidewalls for mounting the decorative components.

12. The container of claim 11, wherein the decorative components are adhesively retained in the recesses.

13. The container of claim 1, wherein the fabric lining is adhesively secured to the interior surface of the sidewalls.

14. The container of claim 1, wherein the fabric lining comprises a laminate of two or more layers.

15. The container of claim 14, wherein the laminate includes an intermediate layer of cushioning material and exterior layers of finer decorative fabric.

16. The container of claim 1, further comprising a fabric gusset extending between the frame members at opposing ends, whereby the opening of the frame members is limited.

17. The container of claim 1, wherein the frame members define an opening that is selected from the group of rectilinear, curvilinear, and combinations of linear and curvilinear shapes.

18. The container of claim 17, wherein the frame members are rectilinear and the sidewalls joined to the frame members are rectilinear.

19. The container of claim 17, wherein the frame members are a combination of linear and curvilinear shapes and the sidewalls are curved.

* * * * *